US005816132A

United States Patent [19]

Langner et al.

[11] Patent Number: 5,816,132

[45] Date of Patent: Oct. 6, 1998

[54] LOAD-SENSING PNEUMATIC CONTROL SYSTEM

[75] Inventors: Luke E. Langner, Anderson, S.C.; John V. Chabot, Lavonia, Ga.

[73] Assignee: Ross Operating Valve Company, Troy, Mich.

[21] Appl. No.: 878,257

[22] Filed: Jun. 18, 1997

Related U.S. Application Data

[60] Provisional application No. 60/021,658 Jul. 12, 1996.

[51] Int. Cl.[6] ..... F15B 13/04

[52] U.S. Cl. ..... 91/391 R; 91/446; 91/454

[58] Field of Search ..... 91/391 R, 446, 91/454

[56] References Cited

U.S. PATENT DOCUMENTS 4,148,248 4/1979 Risk ..... 91/446

*Primary Examiner*—Gerald A. Michalsky

*Attorney, Agent, or Firm*—Harness, Dickey & Pierce, P.L.C.

[57] ABSTRACT

A pneumatic control system for selectively controlling a pneumatically-operated device for controlling movement of a variable load, such as a material handling device or lifting and lowering device, is capable of automatically sensing the load exerted on the pneumatically-operated device and automatically self-compensating for varying loads in order to selectively maintain the load in a static condition. The system further allows for ease of manual manipulation of the load to a new static condition and automatically self-compensates in order to maintain the load at such new static condition. The system preferably accomplishes this by automatically detecting the outlet pneumatic pressure necessary to maintain the load in a first static condition and for automatically self-adjusting the outlet pneumatic pressure to maintain the load in a second static condition.

7 Claims, 4 Drawing Sheets

Fig-1A
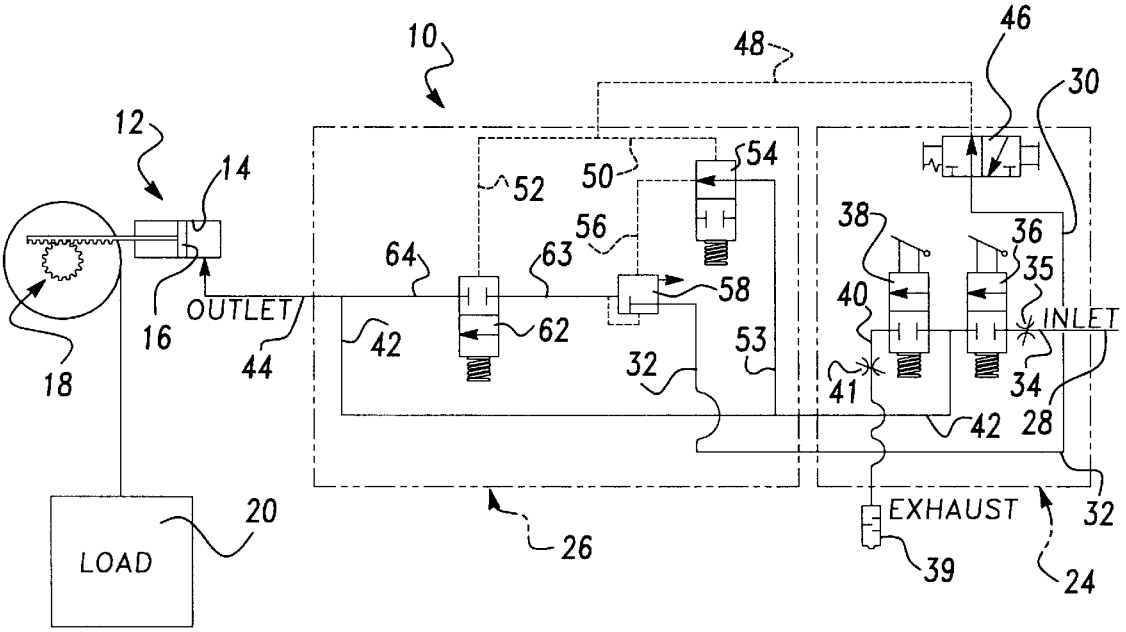
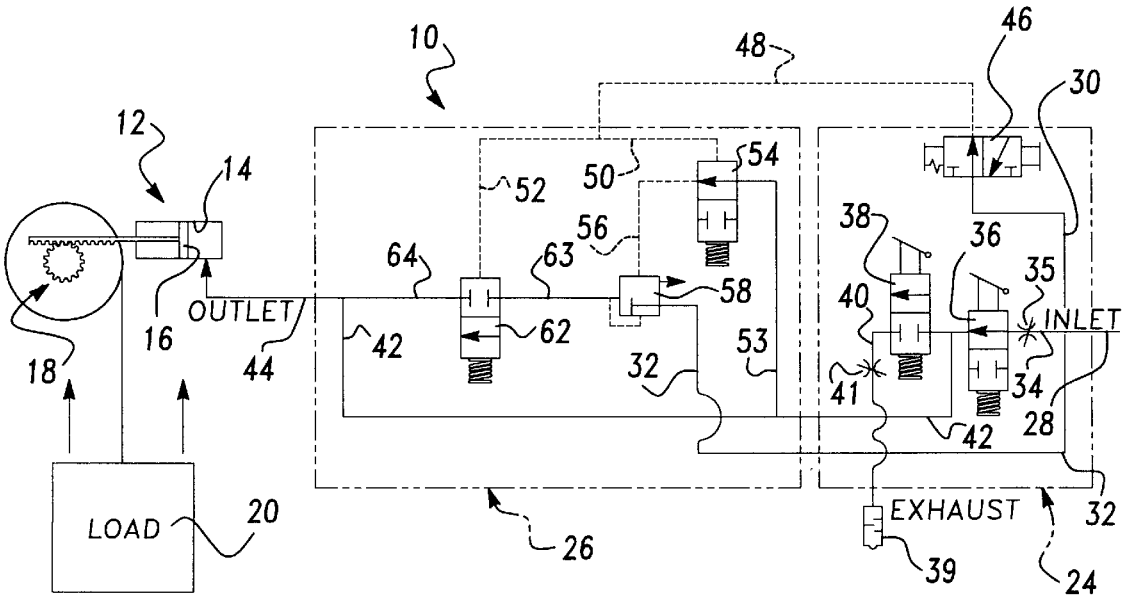
Fig-1B

Fig-1C
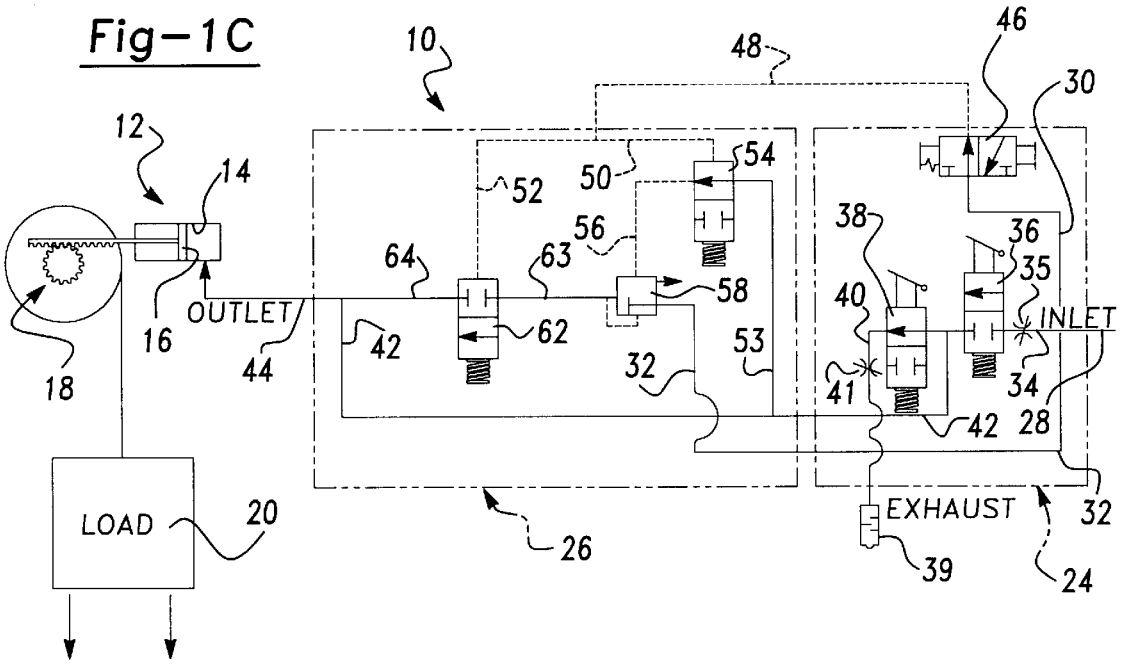
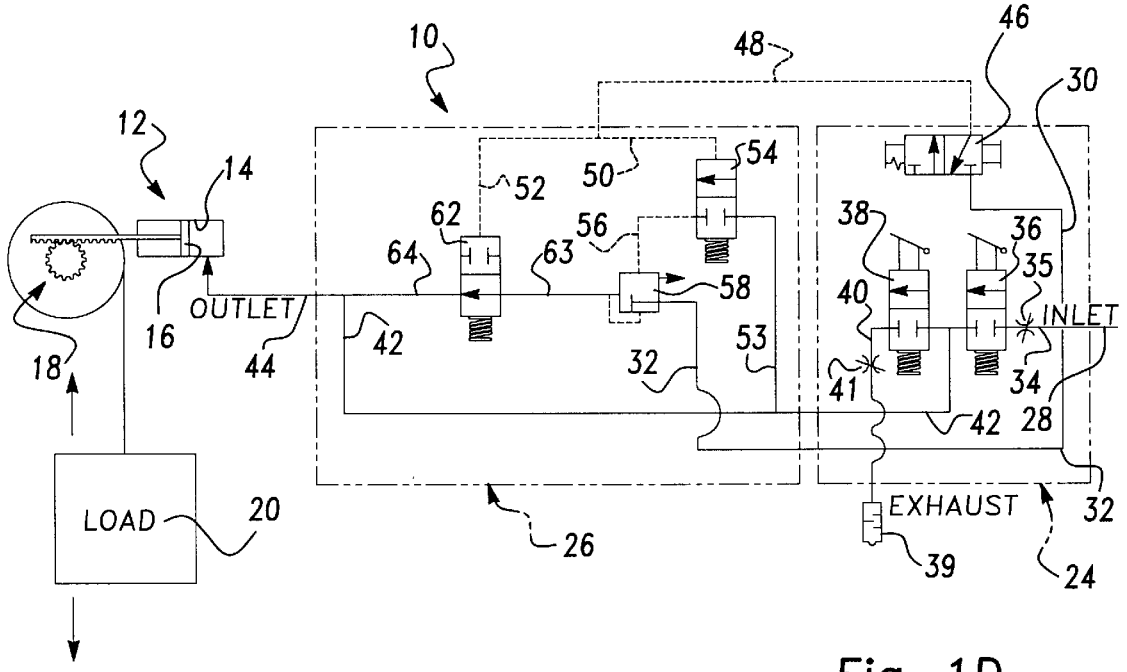
Fig-1D

Fig-2A
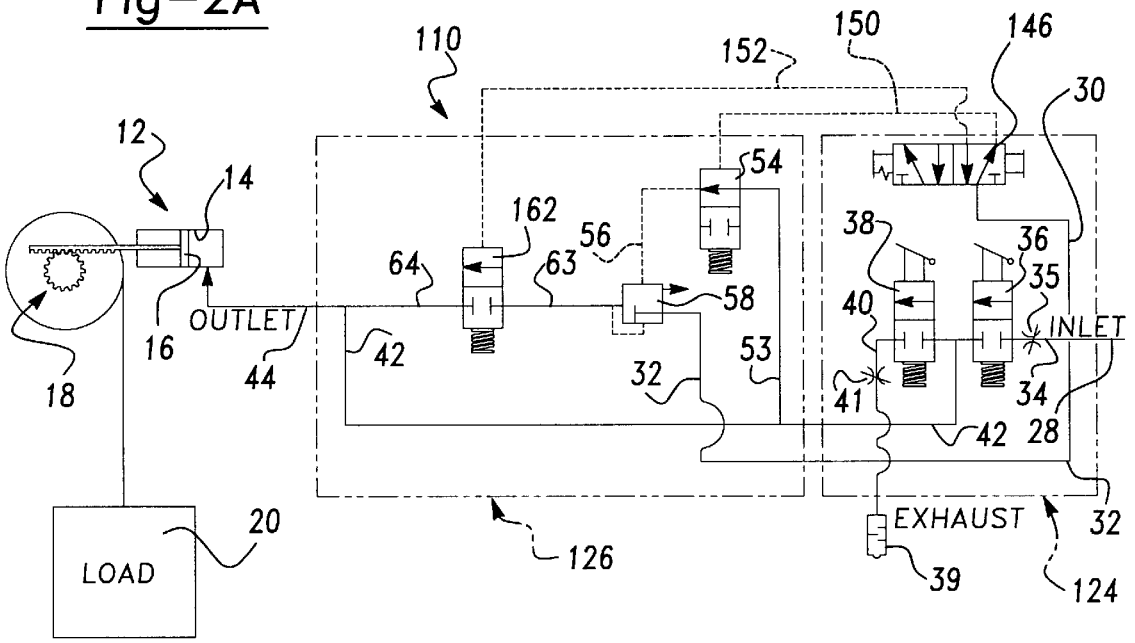
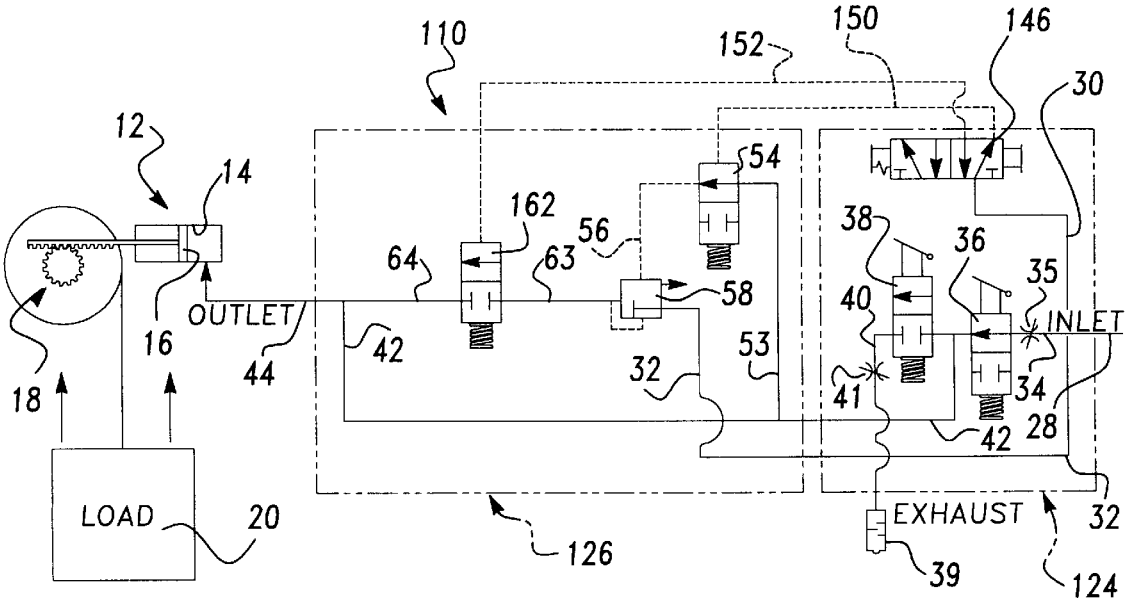
Fig-2B

Fig-2C
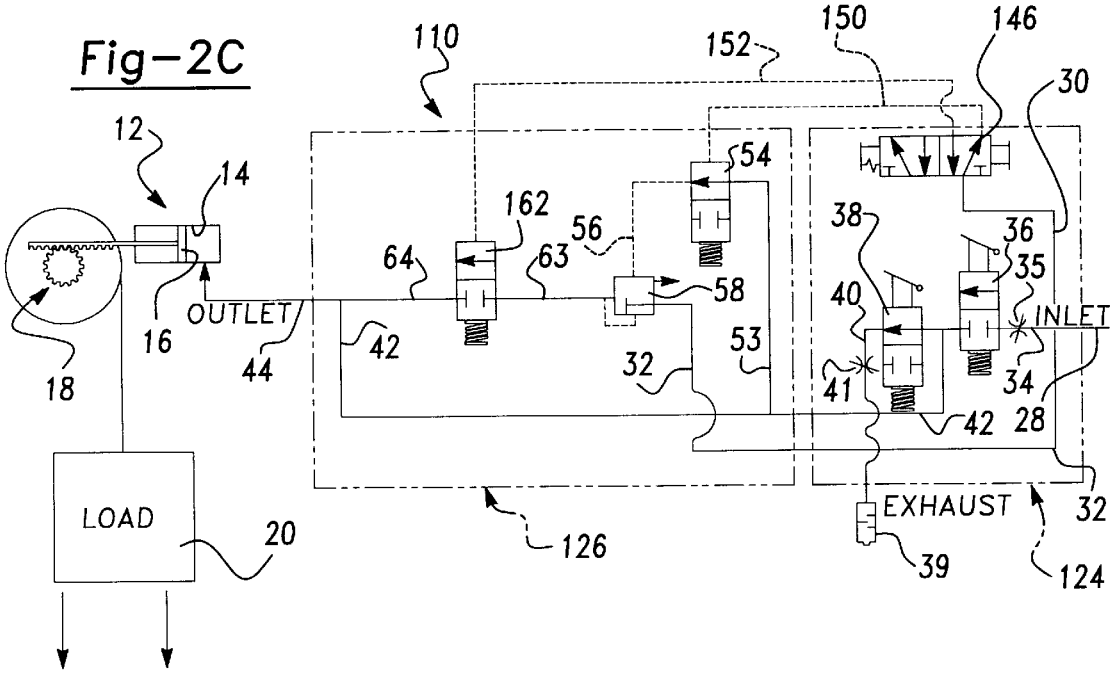
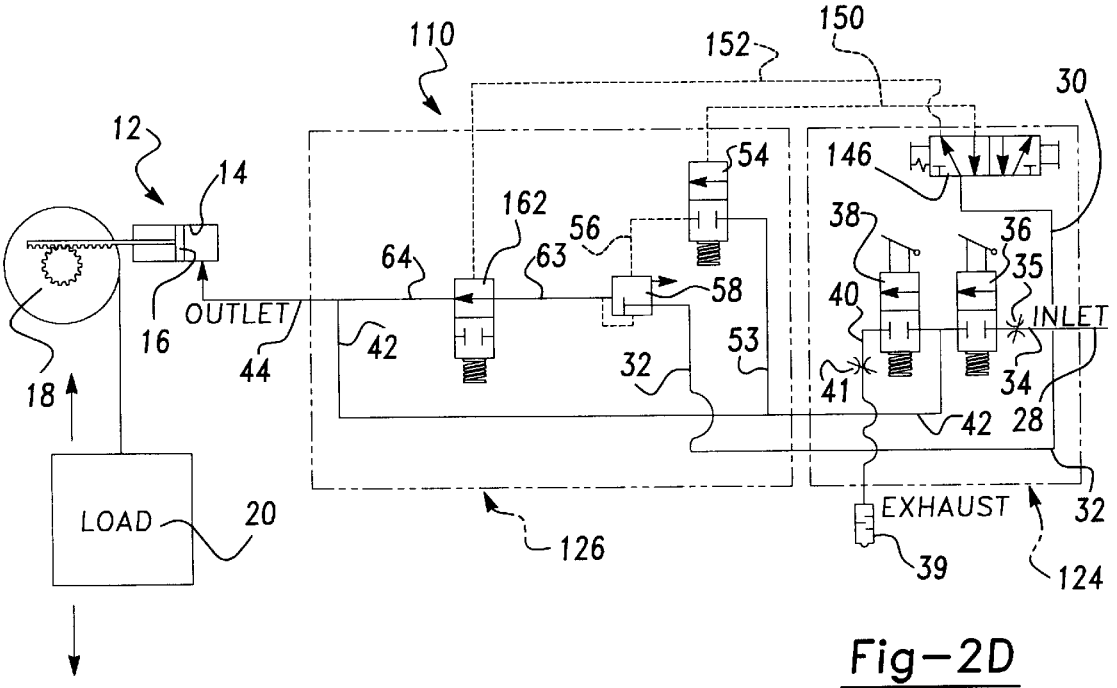
Fig-2D

LOAD-SENSING PNEUMATIC CONTROL SYSTEM

This application claims the benefit of U.S. provisional application No. 60/021,658, filed Jul. 12, 1996.

BACKGROUND AND SUMMARY OF THE INVENTION

The invention relates generally to pneumatic control valves or control valve systems for selectively controlling the movement of pneumatically-operated devices or systems, such as pneumatically-actuated cylinders, clutches, or brakes, for example used to operate various pneumatically-controlled devices. More particularly, the present invention primarily relates to such pneumatic control valve systems adapted for controlling pneumatic-actuated hoists or other such devices for lifting, lowering, holding, or moving a load from one location to another. Still more particularly, the present invention is adapted to allow the operator of such a hoist device to lift or lower loads of varying weights, as well as being capable of automatically sensing the varying weights of such applied loads in order to produce a counterbalance effect that will maintain the load in place or allow the operator to physically position the load with little effort.

Pneumatic control valves or control valve systems are commonly used in various material handling operations or processes for controlling the flow of pressurized control air to and from a pneumatically-operated cylinder or other such pneumatically-actuated hoist device. Frequently, however, the operator of such pneumatically-actuated lifting or hoist devices is confronted with the task of handling and moving materials of various weights, thus presenting the control system with the problem of coping with varying loads. In such systems, the hoist is typically controlled by a hand-held unit, which is manipulated by the operator and equipped with a small, finite number of adjustable orifices corresponding to a small, finite number of commonly-encountered loads to be handled and moved. In such systems, the operator must manually adjust the various orifices to balance these known or expected loads, and the operator constantly bleeds air through such pre-set adjustable orifices in the course of lifting, lowering, or holding the materials of varying load weights encountered. These systems thus require the operator to frequently re-adjust the variable orifices on the hand-held portion of the control system to accommodate loads other than those for which the system has been pre-set. In addition, the adjustable orifices in such systems must be very precisely adjusted or the load will undesirably shift, either upwardly or downwardly, at times when the operator's task requires the load to be held stationary.

Accordingly, the need has arisen for a pneumatic control valve system that is capable of addressing the above-mentioned problems. To this end, the present invention provides a pneumatic control valve system that allows the operator to lift or lower loads of varying weights, as well as being capable of sensing the weight of a wide variety of loads in order to produce a counterbalance effect that will hold these loads in stationary vertical positions, thus allowing the user to easily and conveniently physically move the loads from one location to another. Besides having the capability of automatically self-compensating for the varying loads encountered by the operator, the present invention substantially eliminates the constant bleeding of air from the finite, pre-set orifices of previous systems during load-holding operations, thus reducing the amount of energy necessary to keep the pneumatic control valve system in operation.

A pneumatic control system, according to the present invention, for selectively controlling a pneumatically-operated device for controlling movement of a variable load, such as a material handling device or lifting and lowering device, is capable of automatically sensing the load exerted on the pneumatically-operated device and automatically self-compensating for varying loads in order to selectively maintain the load in a static condition. The system further allows for ease of manual manipulation of the load to a new static condition and automatically self-compensates in order to maintain the load at such new static condition. The system preferably accomplishes this by automatically detecting the outlet pneumatic pressure necessary to maintain the load in a first static condition and for automatically self-adjusting the outlet pneumatic pressure to maintain the load in a second static condition.

Additional objects, advantages, and features of the present invention will become apparent from the following description and the appended claims, taken in conjunction with the accompanying drawings.

BRIEF DESCRIPTION OF THE DRAWINGS

FIG. 1A is a schematic or diagrammatic illustration of a pneumatic control system, according to the present invention, having a stationary portion of the system mounted on an air hoist or other air-actuated lifting and positioning device, as well as having a remote, movable hand-held portion of the system adapted to be manipulated by the operator, with the control system in a load-sensing mode.

FIG. 1B is a schematic or diagrammatic illustration similar to that of FIG. 1A, but illustrating the control system in a load-lifting mode.

FIG. 1C is a schematic or diagrammatic illustration similar to that of FIGS. 1A and 2A, but illustrating the control system in a load-lowering condition.

FIG. 1D is a schematic or diagrammatic view similar to that of FIGS. 1A through 1C, but illustrating the control system in a load-holding mode wherein the operator can push or pull the load, either horizontally or vertically upwardly and downwardly, with very little effort.

FIG. 2A is a schematic or diagrammatic illustration of an alternate pneumatic control system, according to the present invention, having a stationary portion of the system mounted on an air hoist or other air-actuated lifting and positioning device, as well as having a remote, movable hand-held portion of the system adapted to be manipulated by the operator, with the control system in a load-sensing mode.

FIG. 2B is a schematic or diagrammatic illustration similar to that of FIG. 2A, but illustrating the control system in a load-lifting mode.

FIG. 2C is a schematic or diagrammatic illustration similar to that of FIGS. 2A and 2B, but illustrating the control system in a load-lowering condition.

FIG. 2D is a schematic or diagrammatic view similar to that of FIGS. 2A through 2C, but illustrating the control system in a load-holding mode wherein the operator can push or pull the load, either horizontally or vertically upwardly and downwardly, with very little effort.

DETAILED DESCRIPTION OF THE PREFERRED EMBODIMENTS

FIGS. 1A through 2D illustrate two exemplary embodiments of a pneumatic control system according to the present invention, as applied in a pneumatically-controlled system for controlling an air-actuated hoist or other such material handling apparatus for selectively lifting, lowering, or moving a load from place to place. Such application is, of course, shown merely for purposes of exemplary illustration, and one skilled in the art will readily recognize from the discussion herein, taken along with the accompanying drawings and claims, that the principles of the present invention are equally applicable in a wide variety of other material-handling applications, as well as in still other diverse applications wherein the load or force encountered by a pneumatic cylinder or other pneumatically-actuated device is variable. In addition, one skilled in the art will readily recognize that the various components of a pneumatic control according to the present invention can be arranged in a variety of different ways and in a variety of different physical configurations, including separate components interconnected with one another as a system, as well as integrated blocks or mechanisms having the various functional components of the present invention incorporated therein.

In FIG. 1A an exemplary embodiment of a load-sensing pneumatic control system 10, according to the present invention, includes an air hoist 12, or other similar pneumatically-actuated lifting or positioning device, which can include, for example, an air cylinder 14, a piston 16 slidably positioned within the air cylinder 14, an exemplary and diagrammatically-illustrated hoist crank apparatus 18, all of which are adapted for lifting, lowering, and otherwise handling a load 20.

The load-sensing pneumatic control system 10 further includes a hand-held portion 24 and a stationary portion 26, which are pneumatically interconnected in fluid communication with one another, as well as being interconnected in fluid communication with the air cylinder 14. Pressurized pneumatic control air is introduced into the control system 10 by way of an inlet 28, which splits into three pneumatic lines 30, 32 and 34. Inlet line 34 includes an adjustable inlet orifice 35, which communicates with a fill valve 36, which is preferably a normally-closed two-port, two-position valve, the outlet of which splits between a control line 42 (described below) and the inlet of a dump valve 38, which is also preferably a normally-closed two-port, two-position valve. The outlet of the dump valve 38 communicates with an exhaust line 40, an adjustable exhaust orifice 41, and an exhaust muffler 39. The control line 42, connected between the fill valve 36 and the dump valve 38, communicates the outlet of the fill valve 36 with the system outlet 44, which is in turn interconnected in fluid communication with the air cylinder 14.

Inlet line 30, mentioned above, provides pneumatic fluid communication between the inlet 28 and a selector valve 46, which is preferably a detented three-port, two-position valve. The selector valve 46 transmits a pneumatic pilot signal, by way of pilot lines 48 and 50 to a sensing valve 54, which is preferably a normally-closed two-port, two-position valve. The sensing valve 54 has its inlet interconnected in fluid communication, by way of control line 53, with the control line 42 and the outlet of the fill valve 36. The outlet of the sensing valve 54 is connected for fluid communication with a remote-piloted relieving regulator 58 (described below) by way of a pilot line 56.

The selector valve 46 also transmits a pilot signal, by way of the pilot line 48 and a pilot line 52, to a regulator output valve 62, which is preferably a normally-open two-port, two-position valve. This regulator output valve 62 has its inlet interconnected, by way of line 63, with the output of the remote-piloted relieving regulator 58, which can be of an air-piloted, exhaustible type of regulator well-known to those skilled in the art. The remote-piloted relieving regulator 58 in turn has its inlet interconnected, by way of the control line 32, with the system inlet 28 and is controlled by pilot pneumatic air pressure from the outlet of the sensing valve 54. The output of the remote-piloted relieving regulator 58 is interconnected with the system outlet 44 by way of the regulator output valve 62 and control lines 63 and 64.

The function and operation of the load-sensing pneumatic control system 10 is illustrated in FIGS. 1A through 1D. In FIG. 1A, the control system 10 is in a holding or load-sensing mode, with the load 20 being held in a stable, static condition, in which the control system 10 automatically self-compensates for the load weight exerted on the air hoist 12. During this operation, with the selector valve 46 in the position shown in FIG. 1A, the selector valve 46 allows the system to sense the control pressure necessary to hold the load 20 in a static condition. This is because the pneumatic pressure in lines 48, 50, 52, 56, 63 and 64 are equal, at the set pressure for the regulator 58. Once the load has reached its desired position and is at rest, the selector valve 46 can be shifted by the operator to place the control system 10 in the static, counterbalance mode shown in Figure 1D, explained in more detail below.

In order to lift the load, as schematically illustrated in FIG. 1B, the operator actuates the fill valve 36 in the hand-held portion 24 of the control system 10, thus allowing inlet pressure to be communicated directly to the system outlet 44 by way of the control line 42. In this mode, the inlet pressure actuates the air hoist 12 in order to extend the piston 16 of the exemplary air hoist device 12, thus raising the load 20 by way of the hoist crank 18.

Conversely, as is illustrated in FIG. 1C, when the operator wishes to lower the load 20, the positions of the fill valve 36 and the dump valve 38 are reversed relative to their positions shown in FIG. 1B, thus exhausting pneumatic air pressure from the system outlet 44, by way of the control line 42, to the exhaust line 40. This exhaust operation allows the piston 16 to retract within the air cylinder 14, thus reversing the direction of the hoist crank 18 and allowing the load 20 to lower under the influence of gravity.

It should be noted, with reference to FIGS. 1B and 1C, that the remote-piloted relieving regulator 58 should preferably be included within the stationary portion 26 of the control system 10, in order to be physically close to the air hoist 12. Such close proximity substantially minimizes the volume of pressurized pneumatic control air in the lines 63 and 64, thereby requiring less movement of the load to effect pressure changes and thus resulting in quicker response times, either for lowering or lifting the load 20, or for sensing and maintaining the load in a static position, as illustrated in FIG. 1A and FIG. 1D. It should further be noted that the adjustable flow control orifices 34 and 41 can be adjusted by the operator to pre-select the desired load lifting and lowering speeds.

Referring to FIG. 1D, wherein the output pressure at the system outlet 44 is equal to the static pressure required to maintain the load 20 in a stationary condition, the operator can then physically lift the load, with very little physical effort, in which case the remote-piloted relieving regulator 58 automatically supplies the pneumatic control air volume needed to maintain static pressure and keep the load in the lifted, new stationary position. On the other hand, the operator can also physically lower the load, again with very little effort, and the remote-piloted relieving regulator will automatically exhaust pneumatic air pressure to an extent necessary to maintain the control system 10 in the counterbalance position illustrated in FIG. 1D.

Thus, as can be readily recognized by one skilled in the art, the control system 10 allows the operator increased capability and ease of control when lifting or lowering loads of varying weights, as well as providing for automatic self-compensating sensing of these applied loads in order to maintain the load in a desired stationary position and producing a counterbalance effect that allows the user to physically position the load with little effort when in such counterbalancing mode.

In FIGS. 2A through 2D, an alternate load-sensing pneumatic control system 110 is illustrated. The alternate control system 110 incorporates many of the same components of the control system 10 described in connection with FIGS. 1A through 1D, except for the substitution of a selector valve 146, which is preferably a detented five-port, two-position pneumatic control valve in place of the detented three-port, two-position selector valve 46 in the control system 10. In addition, a regulator output valve 162, which is preferably a normally-closed two-port, two-position valve, is substituted for the normally-open two-port, two-position valve 62 shown in FIGS. 1A through 1D. In all other respects, however, the components, function and operation of control system 110 are the same as those described above for the control system 10 of FIGS. 1A through 1D. Although the control system 110 of FIGS. 2A through 2D requires additional piping with respect to that required for the control system 10 in FIGS. 1A through 1D, its use may be desirable in terms of various operational considerations which might be dictated by the needs of a particular installation.

The foregoing discussion discloses and describes merely exemplary embodiments of the present invention for purposes of illustration only. One skilled in the art will readily recognize from such discussion, and from the accompanying drawings and claims, that various changes, modifications, and variations can be made in the exemplary embodiments depicted and described herein without departing from the spirit and scope of the invention as defined in the following claims.

We claim:

1. A pneumatic control system for selectively controlling a pneumatically-operated device for moving and holding varying loads, said control system having an inlet connected to a source of pressurized air, an exhaust, and an outlet for supplying pressurized air to the pneumatically-operated device in order to selectively effect movement and holding of the load, said control system further including load-sensing means for automatically sensing the load exerted on the pneumatically-operated device and for automatically self-compensating for varying loads in order to selectively maintain a particular load in a first static condition and to allow for manual manipulation of the particular load when the particular load is in said static condition.

2. A pneumatic control system according to claim 1, wherein said load-sensing means includes means for automatically detecting the outlet pneumatic pressure necessary to maintain the particular load in said first static condition and for automatically self-adjusting said outlet pressure to maintain the particular load in a second static condition different from said first static condition.

3. A pneumatic control system according to claim 1, wherein said load-sensing means includes a remote-piloted exhaustible pneumatic pressure regulator and air pilot means for placing said regulator in fluid communication with both said inlet and said outlet when the load is placed in a first static condition, to said regulator automatically detecting pneumatic pressure in said outlet and maintaining said outlet at a first outlet pressure sufficient to hold the load in said first static condition and automatically respond to changes in said pneumatic pressure in said outlet and maintaining said outlet at a second outlet pressure sufficient to hold the load in a second static condition when the load is manually manipulated to a second static condition.

4. A pneumatic control system according to claim 3, wherein said air pilot means includes an operator-actuable selector valve, said selector valve being selectively actuable by the operator into and out of a static load position for placing said regulator respectively into and out of said fluid communication with both said inlet and said outlet wherein said regulator automatically detects said pneumatic pressure in said outlet.

5. A pneumatic control system according to claim 3, wherein said regulator includes a pilot port and said air pilot means further includes a sensing valve for placing said regulator pilot port into fluid communication with said inlet when the load is being moved by said control system and for blocking said fluid communication between said regulator pilot port and said inlet when said regulator is placed in said fluid communication with both said inlet and said outlet.

6. A pneumatic control system according to claim 5, wherein said air pilot means includes a regulator output valve for placing said regulator into and out of said fluid communication with both said inlet and outlet.

7. A pneumatic control system according to claim 6, wherein said air pilot means further includes an operator-actuable selector valve, said selector valve being selectively actuable by the operator between a load-moving position wherein the load is moved by way of pneumatic operation of said pneumatically-operated device by said control system and a static load position wherein the load can be manually manipulated by the operator between said first and second static conditions, said selector valve causing said sensing valve to place said regulator pilot port from fluid communication with said inlet and causing said regulator output valve to block said regulator from said fluid communication with both said output and said inlet when said selector valve is in said load-moving position, and said selector valve causing said sensing valve to block said regulator pilot port from fluid communication with said inlet and causing said regulator output valve to place said regulator in said fluid communication with both said output and said inlet when said selector valve is in said static load position.

* * * * *